US008613491B1

(12) United States Patent
Bledsoe et al.

(10) Patent No.: US 8,613,491 B1
(45) Date of Patent: Dec. 24, 2013

(54) PRINTING ON PLANAR OR NON-PLANAR PRINT SURFACE WITH HANDHELD PRINTING DEVICE

(75) Inventors: James D. Bledsoe, Corvallis, OR (US); Asher Simmons, Corvallis, OR (US); James Mealy, Corvallis, OR (US); Gregory F. Carlson, Corvalis, OR (US); Todd A. McClelland, Corvallis, OR (US)

(73) Assignee: Marvell International Ltd., Hamilton (BM)

( * ) Notice: Subject to any disclaimer, the term of this patent is extended or adjusted under 35 U.S.C. 154(b) by 0 days.

(21) Appl. No.: 13/556,071

(22) Filed: Jul. 23, 2012

Related U.S. Application Data

(63) Continuation of application No. 11/955,209, filed on Dec. 12, 2007, now Pat. No. 8,226,194.

(60) Provisional application No. 60/883,110, filed on Jan. 2, 2007.

(51) Int. Cl.
*B41J 29/38* (2006.01)

(52) U.S. Cl.
USPC ..... 347/14; 347/19

(58) Field of Classification Search
USPC ..... 347/14, 19
See application file for complete search history.

(56) References Cited

U.S. PATENT DOCUMENTS 6,360,656 B2 * 3/2002 Kubo et al. ..... 101/35
2002/0154186 A1 * 10/2002 Matsumoto ..... 347/14

* cited by examiner

*Primary Examiner* — Laura Martin

(57) ABSTRACT

Apparatuses and methods for a handheld printing device that allow the handheld printing device to print images onto a planar or non-planar print surface are described herein. The handheld printing device includes a print head, a position module, and a print module. The print head is designed to deposit one or more printing substances onto a print surface. The position module is designed to generate mapping information of the print surface including three dimensional location of a print spot of the print surface, and to generate positioning information indicating three dimensional location of the handheld printing device relative to the print medium. The print module is designed to control the print head, to cause the print head to deposit or not to deposit one or more of the printing substances onto the print spot based, at least in part, by comparing the positioning information to the mapping information.

8 Claims, 10 Drawing Sheets

PRINTING ON PLANAR OR NON-PLANAR PRINT SURFACE WITH HANDHELD PRINTING DEVICE

CROSS-REFERENCES TO RELATED APPLICATIONS

The present application is a continuation of and claims priority to U.S. patent application Ser. No. 11/955,209, filed Dec. 12, 2007, entitled "Printing on Planar or Non-Planar Print Surface with Handheld Printing Device", which claims priority to U.S. Patent Application No. 60/883,110, filed Jan. 2, 2007, entitled "Sensing Print Plane for Hand-Held Printer," the entire disclosure of which is hereby incorporated by reference in its entirety for all purposes.

TECHNICAL FIELD

Embodiments of the present invention relate to the field of printing and, more particularly, to printing on a planar or non-planar print surface using a handheld printing device.

BACKGROUND

Traditional printing devices rely on a mechanically operated carriage to transport a print head in a linear direction as other mechanics advance a print medium in an orthogonal direction. As the print head moves over the print medium an image may be laid down. Portable printers have been developed through technologies that reduce the size of the operating mechanics. However, the principles of providing relative movement between the print head and print medium remain the same as traditional printing devices. Accordingly, these mechanics limit the reduction of size of the printer as well as the material that may be used as the print medium.

Handheld printing devices have been developed that ostensibly allow an operator to manipulate a handheld device over a print medium in order to print an image onto the medium. However, these devices are challenged by the unpredictable and nonlinear movement of the device by the operator. The variations of operator movement, including rotation and tilt of the device itself, make it difficult to determine the precise location of the print head relative to the print surface of the print medium. This type of positioning error may have deleterious effects of the quality of the printed image.

Moreover, with conventional handheld printing devices it is assumed that the print medium will have a flat or planar print surface on which to perform the printing operation. However, if the print medium has a print surface that includes portions that include curved, bumpy, sharp edges, or have other types of surface irregularities that result in the print surface being non-planar, then it may be very difficult, if not impossible, to successfully print an image onto such a surface using conventional techniques and devices. That is, attempts to print on a non-planar print surface using conventional techniques and devices may result in a degraded image being printed onto the print surface or the printing ink being misdirected and ending up being deposited at unwanted locations such as on the user.

SUMMARY

At least some embodiments of the present invention are based on the technical problem of providing a handheld printing device that may allow a user to print images on either planar or non-planar print surfaces. More specifically, there is provided, in accordance with various embodiments of the present invention, a handheld printing device, or simply a "printing device," that may include, among other things, a print head, a positioning module and a print module.

In accordance with various embodiments of the present invention, the print head may be configured to deposit one or more printing substances onto a print surface of a print medium. The position module may be configured to generate mapping information of the print surface including three-dimensional location information of a print spot of the print surface, and to generate positioning information indicating three-dimensional location information of the apparatus relative to the print medium. Meanwhile, the print module may be configured to control the print head, to cause the print head to deposit, or to not deposit, one or more of the printing substances onto the print spot based, at least in part, by comparing the positioning information to the mapping information.

In some embodiments, the printing device may further comprise navigation sensors configured to provide mapping data of the print spot during a mapping operation, and to provide positioning data of the printing device during a printing operation. For these embodiments, the position module may be further configured to generate the mapping and the positioning information based on the mapping data and the positioning data, respectively.

In some embodiments, the navigation sensors may be further configured to generate mapping data of the print spot including a first tilt value associated with the print spot and to generate positioning data including a second tilt value associated with the apparatus. For these embodiments, the print module may be further configured to cause the print head to deposit, or to not deposit, one or more of the printing substances onto the print spot based, at least in part, on the second tilt value and the first tilt value.

In some embodiments, the navigation sensors may include one or more non-optical navigation sensors configured to generate said first and second tilt values. For these embodiments, the one or more non-optical navigation sensors may include at least one of an accelerometer, a tilt-meter, and a gyroscope.

In some embodiments, the print module may be further configured to cause the print head to deposit, or to not deposit, one or more of the printing substances onto the print spot based on image data provided by an image source in addition to comparing the second tilt value to the first tilt value. For these embodiments, the print module may be further configured to cause the print head to deposit, or to not deposit, one or more of the printing substances onto the print spot based, at least in part, by determining whether the second tilt value is within a predetermined range of the first tilt value.

In some embodiments, the navigation sensors may include one or more optical navigation sensors, and the position module may be further configured to use the one or more optical navigation sensors to generate positioning information including a translation and a rotation of the printing device relative to the print medium.

In some embodiments, the print head includes a plurality of nozzles configured to deposit one or more printing substances onto the print surface, and the print module may be further configured to control the print head to prevent selected ones of the nozzles from depositing one or more of the printing substances onto the print spot based at least in part on the comparing of the positioning information to the mapping information. For these embodiments, the print module may be further configured to receive image data from an image source indicating to the print module to allow the selected ones of the nozzles to deposit the one or more of the printing substances at the print spot, and the print module may be further configured to prevent the selected ones of the nozzles to not deposit the one or more of the printing substances onto the print spot based on the comparing of the positioning information and the mapping information and contrary to the indication of the image data.

In some embodiments, the print device may further include a memory configured to store the mapping information, and the print module is further configured to receive the mapping information from the memory.

According to various embodiments, an article of manufacture is provided comprising a storage medium, and a set of instructions stored in the storage medium, which, when executed by an apparatus, causes the apparatus to perform various operations. These operations may include generating mapping information of a print surface of a print medium, the mapping information including three dimensional location information of a print spot of the print surface, generating positioning information indicating three dimensional location information of a printing device relative to the print medium, comparing the positioning information to the mapping information, and causing a print head of the printing device to deposit or to not deposit one or more printing substances onto the print spot based, at least in part, on the comparison of the positioning information and the mapping information.

In some embodiments, the operations further comprise receiving from navigation sensors of the printing device mapping data of the print spot during a mapping operation, and positioning data of the printing device during a printing operation, wherein the mapping and the positioning information may be based on the mapping data and the positioning data, respectively. For these embodiments, the mapping data of the print spot included a first tilt value associated with the print spot and said positioning data included a second tilt value associated with the printing device, and wherein depositing or not depositing the one or more of the printing substances onto the print spot is also based, at least in part, on the second tilt value and the first tilt value. For these embodiments the navigation sensors may include one or more non-optical navigation sensors, and the operations may further comprise receiving the first and second tilt values from the one or more non-optical navigation sensors. In some embodiments, the first and second tilt values may be generated by using at least one of an accelerometer, a tilt-meter, and a gyroscope.

In some embodiments, the depositing or not depositing the one or more of the printing substances onto the print spot may also be based on image data provided by an image source in addition to the second tilt value and the first tilt value. In the same or alternative embodiments, the depositing or not depositing of the one or more of the printing substances onto the print spot may be based, at least in part, on whether the second tilt value is within a predetermined range of the first tilt value.

In some embodiments, the navigation sensors include one or more optical navigation sensors, and the operations may further comprise using the one or more optical navigation sensors to provide the positioning information including a translation and a rotation of the printing device relative to the print medium. In some embodiments, where the print head includes a plurality of nozzles that are configured to deposit the one or more printing substances onto the print surface, the operations may further comprise controlling the print head to prevent one or more nozzles from depositing one or more of the printing substances onto the print spot based at least in part on the comparison of the positioning information and the mapping information. For these embodiments, the operations may further comprise receiving image data from an image source indicating that the one or more nozzles are to deposit one or more printing substances at the print spot and the one or more nozzles may be prevented from depositing one or more printing substances onto the print spot based on the comparison of the positioning information and the mapping information and contrary to the indication of the image data. In some embodiments, the operations may further comprise receiving the mapping information from a memory.

According to various embodiments, an apparatus is provided comprising a means for depositing one or more printing substances onto a print surface of a print medium, a means for generating mapping information of the print surface, the mapping information including three dimensional location information of a print spot of the print surface, a means for generating positioning information indicating three dimensional location information of the apparatus relative to the print medium, a means for comparing the positioning information to the mapping information, and a means for controlling the depositing means to cause the depositing means to deposit or to not deposit the one or more of the printing substances onto the print spot based, at least in part, on the comparison of the positioning information and the mapping information. In some embodiments, the apparatus may further include a sensor means for providing mapping data of the print spot during a mapping operation and for providing positioning data of the apparatus during a printing operation, wherein the generating mapping and positioning information means is further adapted to generate the mapping and the positioning information based on the mapping data and the positioning data, respectively.

In some embodiments, the mapping data of the print spot includes a first tilt value associated with the print spot, and the positioning data includes a second tilt value associated with the apparatus, wherein the controlling means is further adapted to cause the depositing means to deposit or not to deposit the one or more of the printing substances onto the print spot based, at least in part, on the second tilt value and the first tilt value. For these embodiments, the sensor means may include one or more non-optical sensor means adapted to generate said first and second tilt values. In some embodiments, the one or more non-optical sensor means includes at least one of an accelerometer, a tilt-meter, and a gyroscope.

In some embodiments, the controlling means may be further adapted to cause the depositing means to deposit or to not deposit the one or more of the printing substances onto the print spot based on an image data provided by an image source means in addition to the second tilt value and the first tilt value. In some embodiments, the controlling means is further adapted to cause the depositing means to deposit or to not deposit the one or more of the printing substances onto the print spot based, at least in part, on whether the second tilt value is within a predetermined range of the first tilt value. In some embodiments, the depositing means includes a plurality of nozzle means adapted to deposit one or more printing substances onto the print surface and the controlling means is further adapted to control the depositing means to prevent one or more nozzle means from depositing the one or more of the printing substances onto the print spot based at least in part on the comparison of the positioning information and the mapping information. In some embodiments, the controlling means may be further configured to receive image data from an image source means indicating to the controlling means to allow the one or more nozzle means to deposit the one or more of the printing substances at the print spot, and the controlling means may be further adapted to prevent the one or more nozzle means from depositing the one or more of the printing substances onto the print spot based on the comparison of the positioning information and the mapping information and contrary to the indication of the image data.

These and other features of various embodiments of the present invention are described in greater detail herein.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION

In the following detailed description, reference is made to the accompanying drawings which form a part hereof wherein like numerals designate like parts throughout, and in which are shown, by way of illustration, specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Reference in the specification to "one embodiment" or "an embodiment" means that a particular feature, structure, or characteristic described in connection with the embodiment is included in at least one embodiment. The appearances of the phrase "in one embodiment" in various places in the specification do not necessarily all refer to the same embodiment, but they may.

The phrase "A and/or B" means (A), (B), or (A and B). The phrase "A, B, and/or C" means (A), (B), (C), (A and B), (A and C), (B and C) or (A, B and C). The phrase "(A) B" means (A B) or (B), that is, A is optional.

In the following description, the words "print surface" refers to a surface of a print medium where an image is to be printed, while the words "print spot" merely refers to a location on the print surface where one or more printing substances such as ink may or may not be deposited during the printing of the image. Further, note that a print spot may be an area of the print surface rather than any particular point on the print surface.

Figure 1:
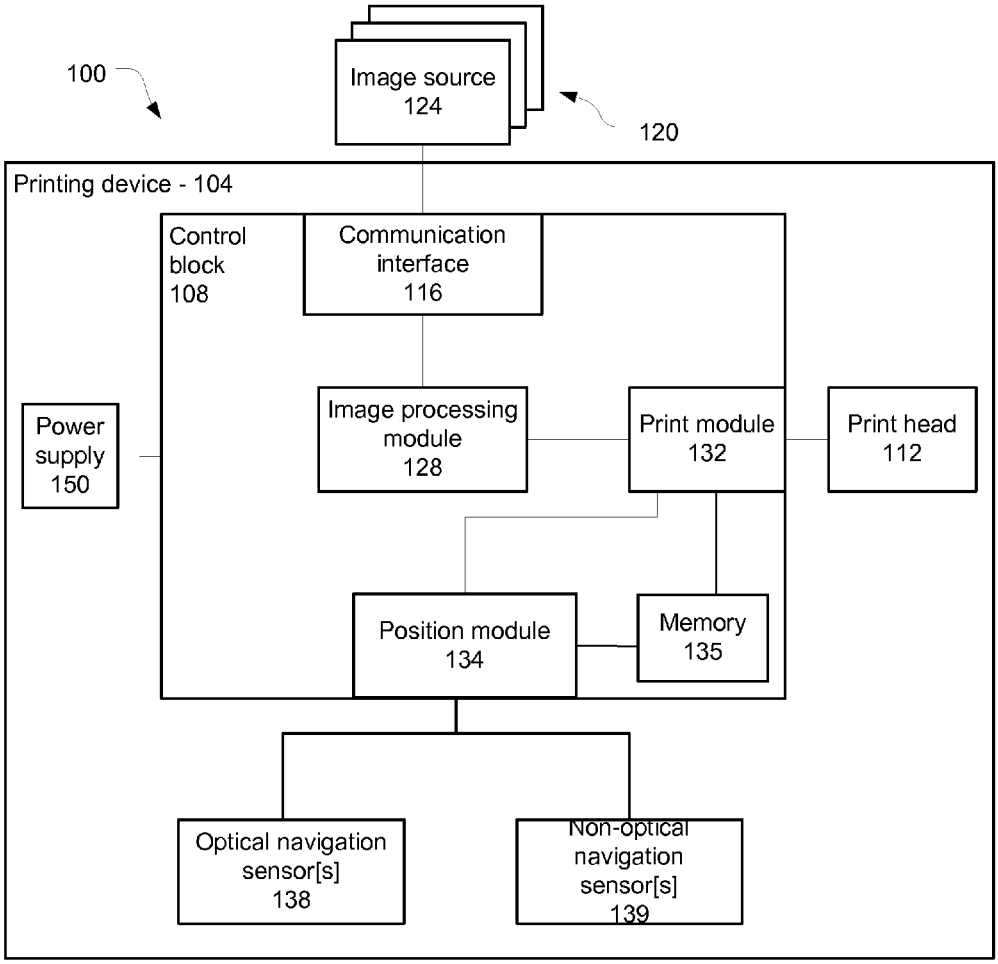
FIG. 1 is a schematic of a system including a handheld printing device in accordance with various embodiments of the present invention.

FIG. 1 is a schematic of a system 100 including a handheld printing device (herein "printing device") 104 in accordance with various embodiments of the present invention. The printing device 104 may be employed in order to print an image onto a print surface of a print medium by, for example, the user sliding or moving the print device 104 back and forth over the print surface. The printing device 104 may include, among other things, components designed to facilitate an initial three dimensional mapping of the print surface, which may be a planar or a non-planar print surface, in order to generate mapping information of the print surface. More particularly, the components may be designed to facilitate three dimensional mappings of different print spots (i.e., different locations) of the print surface that may indicate the locations of the print spots in a three dimensional (xyz) coordinate system.

As will be further described herein, following the mapping operation the mapping information and positioning information of the printing device 104 generated and collected during a subsequent printing operation may be used by the components of the printing device 104 in order to print an image onto the print surface, without significant image degradation even when the print surface is non-planar. In some embodiments, this may be accomplished by precise and accurate control of a print head 112 based, at least in part, on the mapping and positioning information.

Mapping of a print surface may involve determining the topography of the print surface to provide a three dimensional representation of the print surface. For example, during a mapping operation of the print surface, tilt values associated with the print spots of the print surface may be determined, which may be further processed in order to determine corresponding "z" values (in an xyz coordinate system, i.e., a Cartesian coordinate system) for the print spots. In brief, and as will be further described herein, these tilt or z values of the print spots may be compared to the tilt or z values of the print head 112 of the printing device 104 during a subsequent printing operation in order to print an image on the planar or non-planar print surface.

The printing device 104 includes a control block 108, which may further include a communication interface 116 configured to communicatively couple the control block 108 to other devices 120, such as an image source 124. The image source 124 may be any type of device capable of transmitting data related to an image to be printed (herein "image data"). The image source 124 may include a general purpose computing device, e.g., a desktop computing device, a laptop computing device, a mobile computing device, a personal digital assistant, a cellular phone, etc., or it may be a removable storage device, e.g., a flash memory data storage device, designed to store data such as image data. If the image source 124 is a removable storage device, e.g., a universal serial bus (USB) storage device, the communication interface may include a port, e.g., USB port, designed to receive the storage device.

The communication interface 116 may include a wireless transceiver to allow the communicative coupling with the image source 124 to take place over a wireless link. The image data may be wirelessly transmitted over the link through the modulation of electromagnetic waves with frequencies in the radio, infrared or microwave spectrums.

A wireless link may contribute to the mobility and versatility of the printing device 104. However, some embodiments may additionally/alternatively include a wired link communicatively coupling one or more of the other devices 120 to the communication interface 116.

In some embodiments, the communication interface 116 may communicate with the other devices 120 through one or more wired and/or wireless networks including, but not limited to, personal area networks, local area networks, wide area networks, metropolitan area networks, etc. The data transmission may be done in a manner compatible with any of a number of standards and/or specifications including, but not limited to, 802.11, 802.16, Bluetooth, Global System for Mobile Communications (GSM), code-division multiple access (CDMA), Ethernet, etc.

The communication interface 116 may transmit the received image data to an on-board image processing module 128. The image processing module 128 may process the received image data in a manner to facilitate an upcoming printing process. Image processing techniques may include dithering, decompression, half-toning, color plane separation, and/or image storage. In various embodiments some or all of these image processing operations may be performed by the image source 124 or another device. The processed image data may then be transmitted to a print module 132 where it may be stored in anticipation of a print operation. The image data, when further processed by the print module 132, may indicate to the print module 132 whether to deposit or not deposit one or more print substances (i.e., ink) onto the print spots of a print surface. The image data may, in some instances, be ignored by the print module 132 depending upon the mapping and positioning information provided by the position module 134 as will be further described herein.

In any event, prior to commencing a printing operation on a print surface of a print medium, a mapping operation may be performed in order to generate mapping information of the print surface of the print medium. The mapping information may be initially generated by the position module 134 and saved to memory 135 during the initial mapping operation. The mapping information may then be retrieved or accessed from the memory 135 by the print module 132 during the subsequent printing operation. Alternatively, the position module 134 may directly provide the mapping information to the print module 132.

During the printing operation, positioning information of the printing device 104 may be provided to the print module 132 by the position module 134 as the printing device 104 is being moved or slid over the print medium. The position information may indicate the locations and orientations of the print head 112 (as well as the printing device 104) as the printing device 104 is being moved or slid over the print medium during the printing operation. Such positioning information may be defined at least by translation and rotation changes (or simply translations and rotations) of the print head 112 and the printing device 104 itself relative to a reference location as the printing device 104 is being moved over the print medium during the printing operation.

In brief, and as will be further described herein, the translation of the print head 112 (or the printing device 104) is the distance and direction that the print head 112 or the printing device 104 has moved relative to the print medium (or more specifically to the reference location). In brief, and as will be further described herein, the rotation of the print head 112 or the printing device 104 is the rotation of the print head 112 or the printing device 104 relative to the print medium (or the reference location).

The mapping information provided by the position module 134 may further include tilt values associated with print spots of the print surface determined during the mapping operation, while the positioning information generated by the position module 134 during a subsequent printing operation may further include tilt values associated with the printing device 104 during the printing operation. Thus, the position module 134 may provide two functions: first to provide mapping information of the print surface (i.e., locations of the print spots in a three dimensional space); and second to provide positioning information of the print device relative to the reference location during a print operation. In some alternative embodiments, however, the mapping information may be generated by a separate mapping module instead of by the position module 134.

In various embodiments, during the mapping operation, tilt values for print spots of the print surface may be processed by the position module 134 to determine the corresponding z-values (in an xyz Cartesian coordinate system) for the print spots. Such corresponding z-values may be stored in the memory 135 to be accessed by the print module 132 in a subsequent printing operation. Alternatively, the tilt values may, instead, be stored in the memory 135 to be accessed by the print module 132 in the subsequent printing operation.

When the printing operation begins, the print module 132 may be provided with the current positioning information of the printing device 104 from the position module 134 (or from a separate mapping module if there is one). The print module 132 may compare the positioning information to the mapping information to control the print head 112 to selectively deposit a printing substance or substances (e.g., ink) onto the print surface of the print medium. More specifically, in some embodiments, this may mean that the print module 132 may control the print head 112 to prevent the print head 112 from depositing selected printing substances onto the print spots contrary to the image data, which may actually be indicating to the print module 132 to deposit the selected printing substances onto the same print spots. As a result, the printing device 104 is prevented from trying to deposit printing substances onto the print spots whenever the printing device 104 (or the print head 112) is improperly located or oriented with respect to the print spots. That is, during a printing operation, the print module 132 may control the print head 112 to selectively deposit a printing substance or substances onto the print spots of the print surface based on the image data provided by the image source 124, and by comparing the current positioning information of the printing device 104 as provided by the position module 134 with the mapping information of the print spots previously provided by the position module 134. For instance, if, based on the mapping and positioning information, it is determined that the print head 112 is either too far away or too close to the targeted print spot to properly deposit the correct amount of the print substance or substances onto the targeted print spot, then the print module 132 may prevent the print head 112 from depositing the print substance or substances at that location even though the image data may indicate otherwise.

In order to provide both mapping and positioning information, the position module 134 may be communicatively coupled to one or more optical navigation sensors ("optical navigation sensors") 138 and one or more non-optical navigation sensors ("non-optical navigation sensors") 139. The optical navigation sensors 138 may include a light source, e.g., light-emitting diode (LED), a laser, etc., and an optoelectronic sensor designed to take a series of pictures of a print medium adjacent to the printing device 104 as the printing device 104 is moved over the print medium during a mapping or printing operation. The non-optical navigation sensors 139 may include, for example, an accelerometer, a gyroscope, a pressure sensor, a tactile sensor, a tilt-meter, a dot sensor, and/or other types of non-optical sensors.

In a mapping operation, the printing device 104 may, for example, be moved or slid back and forth over the print surface of the print medium. As the printing device is being moved across the print surface, both the optical and the non-optical navigation sensors 138 and 139 may provide raw "mapping data" to be used by the position module 134 in order to generate the mapping information that may provide Cartesian coordinates for print spots of the print surface. For example, the position module 134 may use the optical navigation sensors 138 in order to determine the x- and y-values for a print spot of the print surface, while using one or more non-optical navigation sensors 139 in order to determine a tilt value (or a z value corresponding to the tilt value) for the same print spot. In this case, the tilt value associated with the print spot may be determined based on the tilt of the printing device 104 at the time that the print spot is being mapped. In some embodiments, an accelerometer, a tilt-meter, and/or a gyroscope may be used to determine the z or tilt values.

Similarly, during a printing operation, the optical and non-optical navigation sensors 138 and 139 may cooperatively function together to provide "positioning data" to the position module 134 that may be used by the position module 134 to generate "positioning information" that indicate the translations, rotations, and tilt (or "z") values of the print head 112 during a printing operation. When a printing operation is to be performed on a print surface, the position module 134 may initially receive and process mapping data provided by the non-optical navigation sensors 139 and/or the optical navigation sensors 138. The mapping operation, in brief, involves determining the precise locations of print spots of the print surface in a three dimensional environment (i.e., a Cartesian coordinate system). Thus, print spots of the print surface may be identified by, for example, an x-value, a y-value, and a z-value. Such information may then be provided to the print module 132 in the form of mapping information.

For example, if the non-optical navigation sensors 139 include an accelerometer, a tilt-meter, and/or a gyroscope, then the mapping operation may be performed by moving or sliding the printing device 104 back and forth across the print surface. For each print spot of the print surface, the non-optical navigation sensors 139 may output a corresponding tilt value, which may be processed by, for example, the position module 134, to determine the corresponding z-values for each of the print spots. The z-values may then be saved to the memory 135 to be subsequently provided to the print module 132 during the print operation. Alternatively, the tilt values instead of the z-values may be saved by the position module 134 and subsequently provided to the print module 132. Note that the print spots of the print surface may further be characterized by an "x" and a "y" value in the Cartesian coordinate system as already described.

For the printing operation, the position module 134 may receive and process data from the optical navigation sensors 138 and/or the non-optical navigation sensors 139 in order to determine the locations of the printing device 104, and more particularly the locations of the print head 112, relative to the print medium as the printing device 104 is being moved across the print surface to form the image. For example, in some embodiments, the position module 134 may process pictures provided by the optical navigation sensors 138 to detect structural variations of the surface of the print medium. The movement of the structural variations in successive pictures may indicate motion of the printing device 104 relative to the print medium. Tracking this relative movement may facilitate determination of the precise positioning of the optical navigation sensors 138 including the translations and rotations of the printing device 104 relative to the reference location.

Additionally, the non-optical navigation sensors 139 such as a gyroscope or a tilt-meter may be used to determine the tilts of the printing device 104 during the printing operation, and more particularly, the tilt of the print head 112. The optical navigation sensors 138 and the non-optical navigation sensors 139 may be maintained in a structurally rigid relationship with the print head 112, thereby allowing for the calculation of the precise location and orientation of the print head 112. Thus, the position module 134 may use the combination of both the optical and non-optical navigation sensors 138 and 139 to provide, as a result of the mapping operation, mapping information of the print spots, and to provide, during the printing operation, the positioning information of the printing device 104 relative to the print medium.

As described earlier, in order to print an image onto a print surface, a printing operation may be executed following a mapping operation of the print surface. The printing operation may begin when the printing device 104 is initially placed at a selected location of the print surface of the print medium in order to designate the initially selected location as the reference location.

For instance, if the print medium is a flat rectangular paper, the printing device 104 may be initially placed at one of the corners of the paper. This initial or "starting" location of the printing device 104 relative to the print medium may then be the reference location for the printing device 104. After being placed at its initial location on the print surface, the optical navigation sensors 138 may then take pictures of the initial location to establish the reference location. Data for the pictures of the reference location may be in the form of positioning data and may be provided to the position module 134.

The image to be printed or formed on the print surface may then be printed on the print surface by moving the printing device 104, for example, back and forth across the surface of the print medium. The back and forth movement may be in any manner such as, for example, up and down, circular, side-to-side, zigzag, or other types of movements. Further, in some embodiments, the movement of the printing device 104 across the print surface may not be a continuous motion.

The print medium, as used in embodiments herein, may be any type of medium on which a printing substance, e.g., ink, powder, etc., may be deposited. It is not limited to print paper or other thin, flexible print media commonly associated with traditional printing devices. Furthermore and as previously alluded to, a print medium may have a print surface that is non-planar or planar (i.e., flat).

Referring back to FIG. 1, the optical navigation sensors 138 may have operating characteristics sufficient to track movement of the printing device 104 with the desired degree of precision. In one example, the optical navigation sensors 138 may process approximately 2000 frames per second, with each frame including a rectangular array of 30×30 print spots. Each print spot may detect a six-bit interference value, e.g., capable of sensing 64 different levels of patterns.

The print head 112 may be an inkjet print head having a plurality of nozzles designed to emit liquid ink droplets. The ink, which may be contained in reservoirs or cartridges, may be black and/or any of a number of various colors. A common, full-color inkjet print head may have nozzles for cyan, magenta, yellow, and black ink. Other embodiments may utilize other printing techniques, e.g., toner-based printers such as laser or LED printers, solid ink printers, dye-sublimation printers, inkless printers, etc.

The printing device 104 may include a power supply 150 coupled to the control block 108. The power supply 150 may be a mobile power supply, e.g., a battery, a rechargeable battery, a solar power source, etc. In other embodiments the power supply 150 may additionally/alternatively regulate power provided by another component (e.g., one of the other devices 120, a power cord coupled to an alternating current (AC) outlet, etc.).

Figure 2:
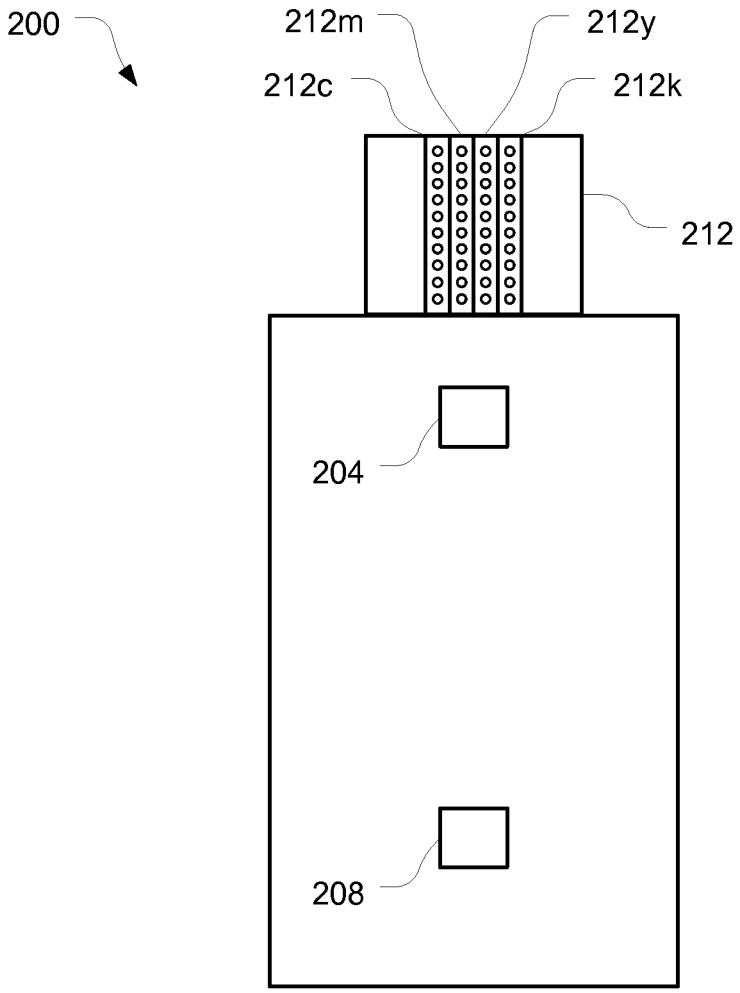
FIG. 2 is a bottom plan view of a handheld printing device in accordance with various embodiments of the present invention.

FIG. 2 is a bottom plan view of a printing device 200 in accordance with various embodiments of the present invention. The printing device 200, which may be substantially interchangeable with printing device 104, may have a first optical navigation sensor 204, a second optical navigation sensor 208, and a print head 212. In some embodiments, the first and second optical navigation sensors 204 and 208 may cooperatively work together to provide positioning and mapping data to the position module 134. Although not depicted, the printing device 200 may further include non-optical navigation sensors as earlier described such as an accelerometer, a gyroscope, a pressure sensor, a tactile sensor, a tilt-meter, a dot sensor, and/or other types of non-optical sensors to facilitate the provision of the positioning and mapping data.

The print head 212 may be an inkjet print head having a number of nozzle rows for different colored inks. In particular, and as shown in FIG. 2, the print head 212 may have a nozzle row 212*c* for cyan-colored ink, a nozzle row 212*m* for magenta-colored ink, a nozzle row 212*y* for yellow-colored ink, and nozzle row 212*k* for black-colored ink.

While the nozzle rows 212*c*, 212*m*, 212*y*, and 212*k* shown in FIG. 2 are arranged in rows according to their color, other embodiments may intermix the different colored nozzles in a manner that may increase the chances that an adequate amount of appropriate colored ink is deposited on the print medium through the natural course of movement of the printing device 200 over the print medium. In some embodiments, the nozzles may spray ink vertically straight down towards a print surface. Alternatively, one or more of the nozzles may spray their respective inks at an angle relative to the print surface and/or the print head 212.

Figure 3:
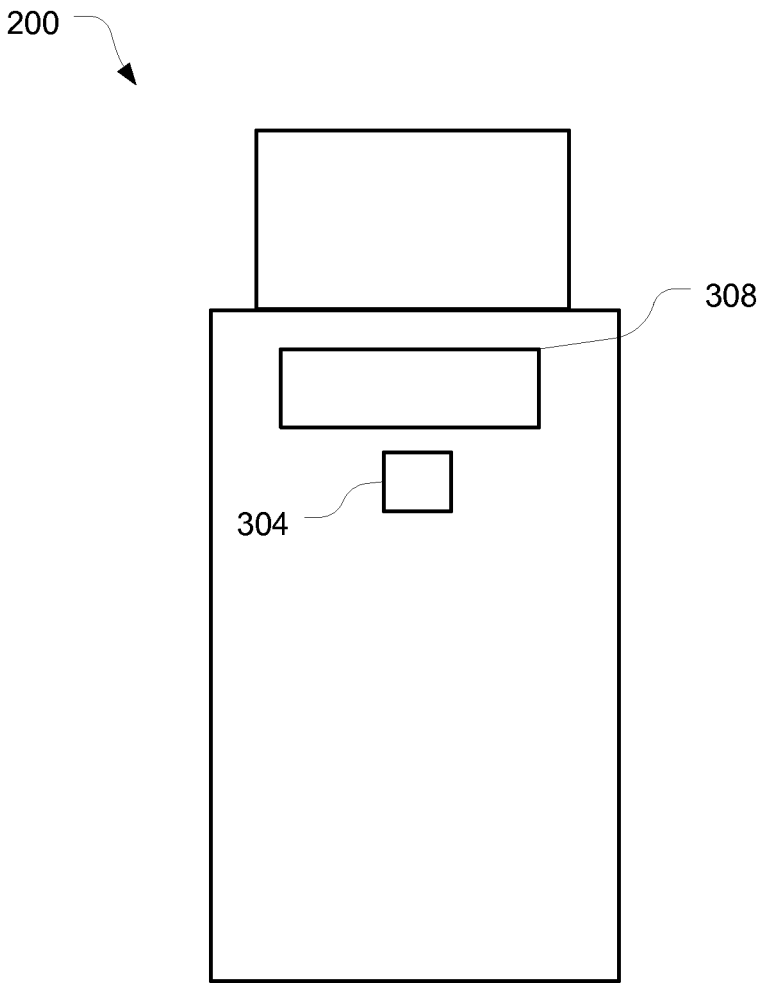
FIG. 3 is a top plan view of a printing device in accordance with various embodiments of the present invention.

FIG. 3 is a top plan view of the printing device 200 in accordance with various embodiments of the present invention. The printing device 200 may have a variety of user input/outputs to provide the functionality enabled through use of the printing device 200. Some examples of input/outputs that may be used to provide some of the basic functions of the printing device 200 include, but are not limited to, a print control input 304 to initiate/resume a print operation and a display 308.

The display 308, which may be a passive display, an interactive display, etc., may provide the user with a variety of information. The information may relate to the current operating status of the printing device 200 (e.g., printing, ready to print, receiving print image, transmitting print image, etc.), power of the battery, errors (e.g., positioning/printing error, etc.), instructions (e.g., "place printing device on print medium prior to initiating printing operation," etc.). If the display 308 is an interactive display it may provide a control interface in addition to, or as an alternative from, the print control input 304.

Figure 4A:
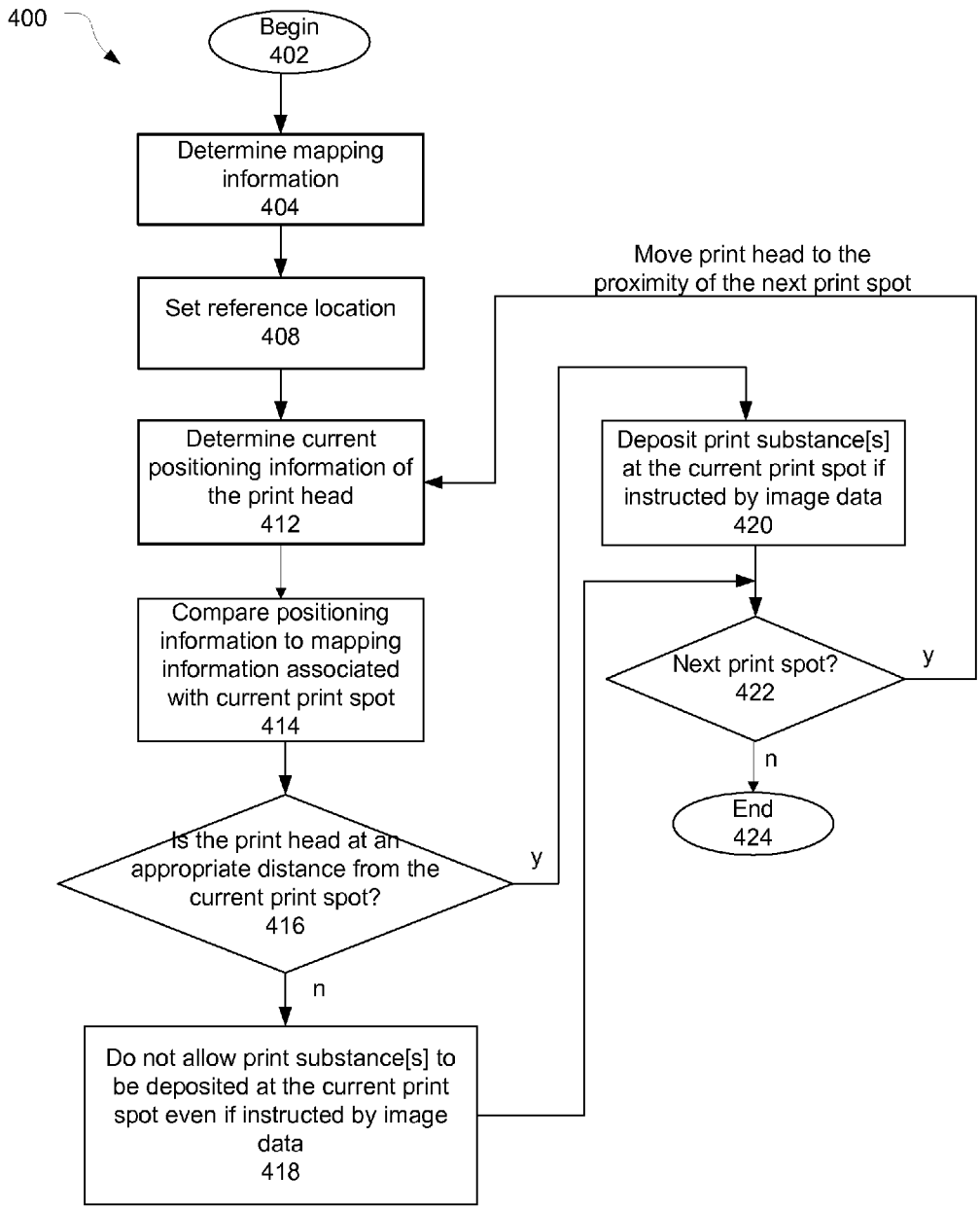
FIG. 4A is a flow diagram depicting a mapping and printing process using a handheld printing device in accordance with various embodiments of the present invention.

FIG. 4A is a flow diagram 400 depicting a mapping and printing process that may be implemented by the printing device 200 in accordance with various embodiments of the present invention. The mapping and printing process 400 may begin at block 402 when a mapping operation, which will be further described below, is performed to determine mapping information of print spots of a print surface at block 404.

After completing the mapping operation, a reference location may be set for the printing operation at block 408. In some instances, the reference location may be set when the printing device 200 is placed at a selected location of the print surface at the beginning of the printing operation. This may be ensured by the user being instructed to activate the print control input 304 once the printing device 200 is in place and/or by the proper placement of the printing device 200 being treated as a condition precedent to instituting the positioning operation. In some embodiments, the proper placement of the printing device 200 may be automatically determined through the navigation sensors 204 and/or 208 and/or some other sensors (e.g., non-optical navigation sensors 139).

Once the reference location is set at block 408, the print head 212 may be moved to the proximity of a first print spot of the print surface, and the current positioning information of the print head 212 may be determined at 412. Note that blocks 412 to 422 of flow diagram 400 generally represent a printing operation for a print spot. The current positioning information may then be compared to the mapping information associated with the current print spot previously determined (during the earlier mapping operation) at block 414. In doing so, a comparison may be made between the three dimensional location of the first print spot (as defined by x, y, and z values in the Cartesian coordinate system), and the current three dimensional location of the print head 212 (as well as the printing device 200). If the print head 212 is not at an appropriate distance from the current print spot at block 416, then the print module 132 may control the print head 212 not to deposit one or more print substances onto the current print spot even if the image data indicates that one or more of the print substances should be deposited at the current print spot at block 418.

On the other hand, if the print head 212 is determined to be at an appropriate distance from the current print spot at block 416, then the print module 132 may control the print head 212 to allow the print head 212 to deposit one or more printing substances onto the current print spot if indicated to do so by the image data at block 420. Note that so long as the print head 212 is within tolerance or within a range of distances from the current print spot, the print head 212 may be allowed to deposit one or more printing substances onto the current print spot.

A determination may then be made as to whether another printing operation will be performed on another print spot at block 422. If so, then the process 400 may return to block 412. On the other hand, if there are no more print spots on which to print (e.g., on which to deposit the print substances), the flow diagram 400 may end at block 424. In some embodiments, the printing operation for a print spot as embodied by blocks 412 to 422 may be repeated for each of the print spots of the print surface.

Figure 4B:
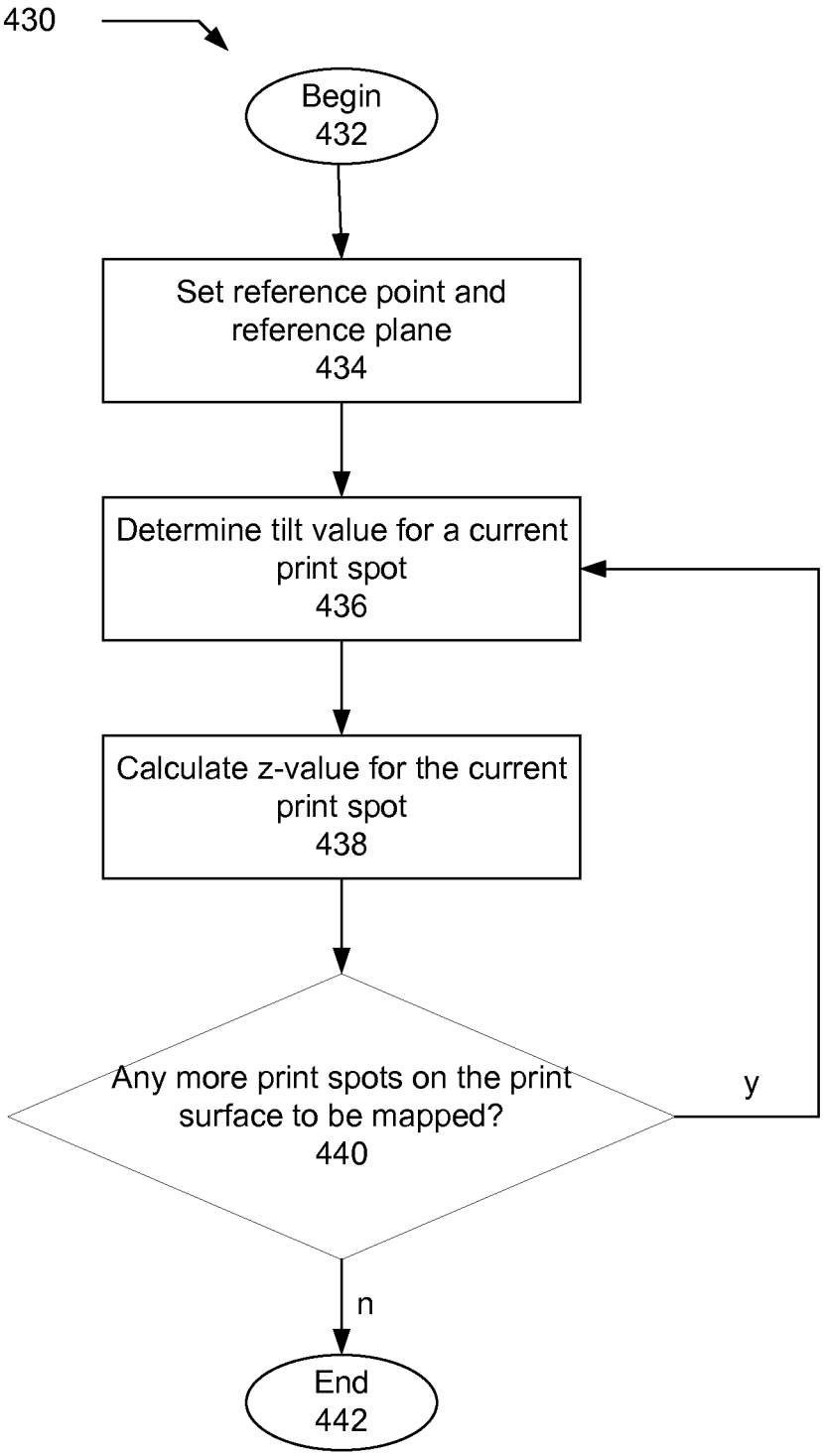
FIG. 4B is a flow diagram depicting a mapping process of a print surface in accordance with various embodiments of the present invention.
Figure 5A:
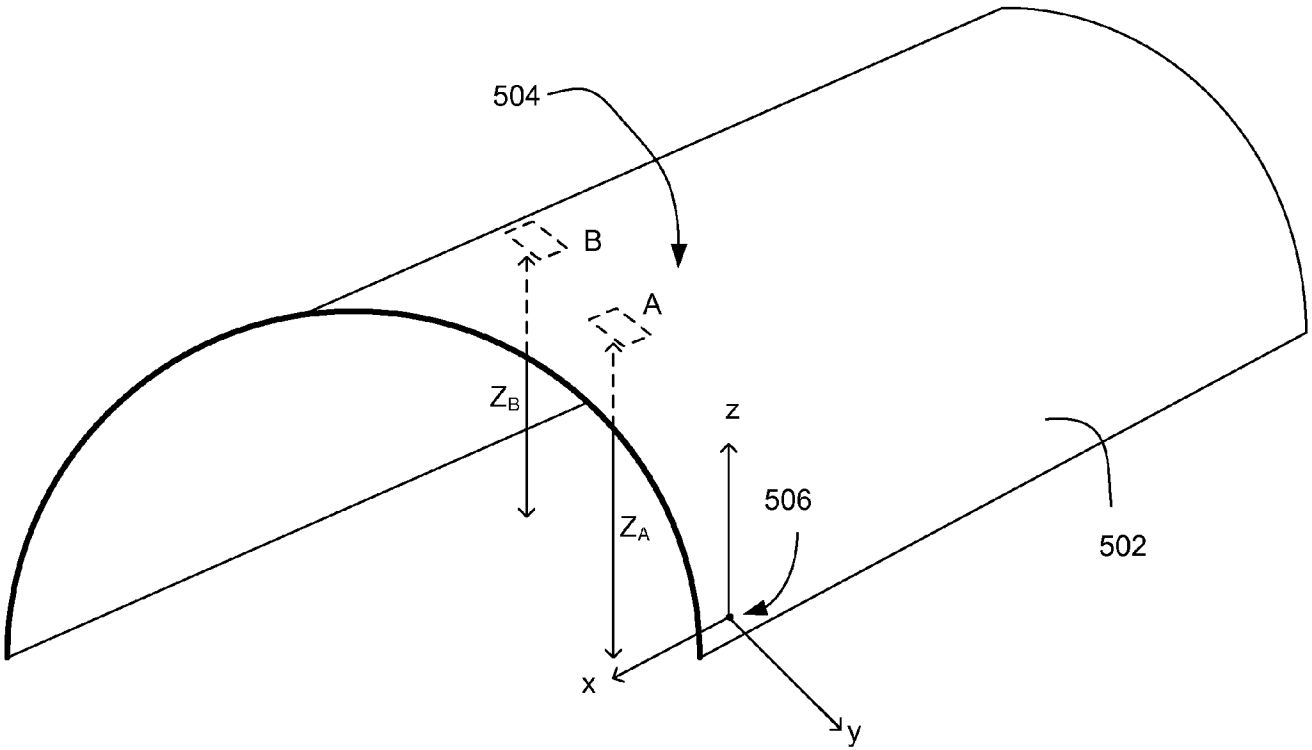
FIG. 5A illustrates a non-planar print surface of a print medium in accordance with various embodiments of the present invention.

Referring now to FIG. 4B, a mapping process to map a planar or non-planar print surface in accordance with various embodiments of the present invention may be described. The mapping process 430 may be best understood with additional reference to FIG. 5A, which depicts a print medium 502 with a curved print surface 504. The mapping process 430 may begin at block 432 when a reference point, which is disposed in a reference plane, is set at block 434. In FIG. 5A, the reference point is indicated by 506, and the reference plane is defined by the x-axis and the y-axis (i.e., the xy plane). In some embodiments, the reference point 506 may be arbitrarily selected. A reference point 506 and/or the reference plane may be needed in order to perform a mapping operation since each print spot on the print surface will need to be mapped against a reference, such as a reference point and/or reference plane. The reference plane may be defined by the x axis and the y axis. Note that the reference point 506 is different from the previously described "reference location." That is, although they may be the same in some instances, the reference point 506 is used during the mapping operation while the reference location is used during the printing operation.

Returning to mapping process 430, after setting the reference point and plane, a tilt value for an initial print spot of the print surface may be determined at block 436. The tilt value may be determined using one or more of the earlier described non-optical navigation sensors 139. The determined tilt value for the initial print spot may then be used in order to calculate a corresponding z value for the initial print spot at block 438. Referring back to FIG. 5A, on the print surface 504 are two print spots A and B as designated by the dotted rectangles. Thus, the calculated z-value for print spot A is $Z_A$, while the calculated Z-value for the print spot B is $Z_B$.

In this example, the z-values for each of the print spots A and B are the distances between the print spots A and B, and the reference plane (i.e., the xy plane). If there are more print spots on the print surface then the mapping process 430 repeats itself by returning to block 436 at block 440, otherwise the mapping process 430 ends at block 442. Thus, each print spot A and B may be defined by their three dimensional locations as represented by an x value, a y value, and a z value.

Figure 5B:
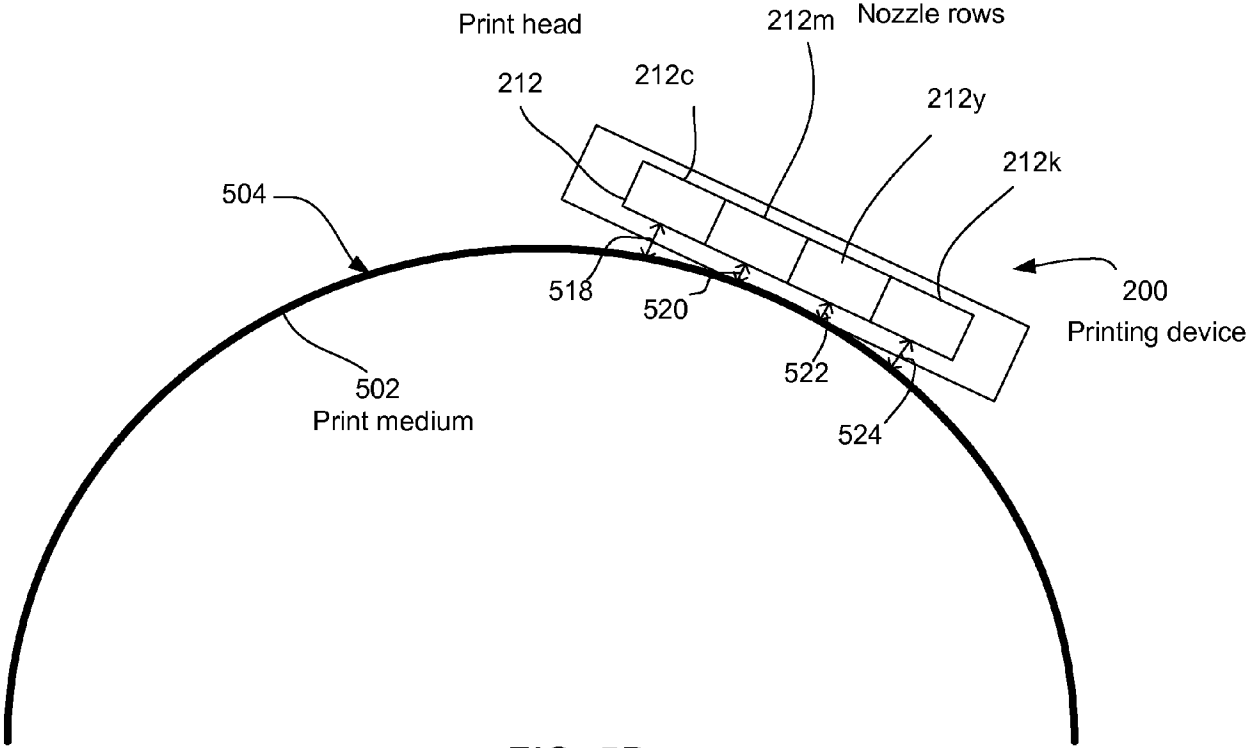
FIG. 5B illustrates the handheld printing device of FIG. 2 on the non-planar print surface of FIG. 5A in accordance with various embodiments of the present invention.

FIG. 5B illustrates a side view of the printing device 200 of FIG. 3 on the print surface 504 of FIG. 5A in accordance with various embodiments of the present invention. Several issues may arise during a printing operation as a result of the non-planar nature of the print surface 504. For example, it may be generally desirable during a print operation to maintain a certain distance or within a narrow range of distance between the nozzle rows 212*c*, 212*m*, 212*y*, and 212*k*, and the print surface 504 to prevent, for example, misapplication of the printing substance. If the nozzle rows 212*c*, 212*m*, 212*y*, and 212*k* are either too close or too far away from the print surface 504, then the printing operation may not be successful.

In this case, and as a result of the non-planarity of the print surface 504, the nozzle rows 212*c*, 212*m*, 212*y*, and 212*k* may be different distances away from the print surface 504. For example, the distance 518 and 524 between the print surface 504 and the two outer nozzle rows 212*c* and 212*k* are greater than the distance 520 and 522 between the print surface 504 and the two inner nozzle rows 212*m* and 212*y*. Thus, although the two inner nozzle rows 212*m* and 212*y* may be at the proper distance from the print surface 504, the outer nozzle rows 212*c* and 212*k* may be too far away to accurately deposit a printing substance (e.g., ink).

Thus, in accordance with various embodiments, a print module 132 may control the print head 212 to deposit or not deposit one or more of the different color inks through the nozzle rows 212*c*, 212*m*, 212*y*, and 212*k*. This may be accomplished by comparing mapping information for the print surface 504 with the current positioning information of the printing device 200. In particular, the decision to allow selected ones of the nozzle rows 212*c*, 212*m*, 212*y*, and 212*k* to deposit ink may be based, at least on a comparison of the current tilt value of the printing device, as included in the positioning information, with the tilt value associated with the relevant print spot, as included in the mapping information. In some alternative embodiments, the corresponding Z-values determined from the tilt values may be compared instead in order to make the determination as to whether the selected ones of the nozzle rows 212*c*, 212*m*, 212*y*, and 212*k* will be allowed to deposit ink as directed or indicated by the image data.

Figure 6A:
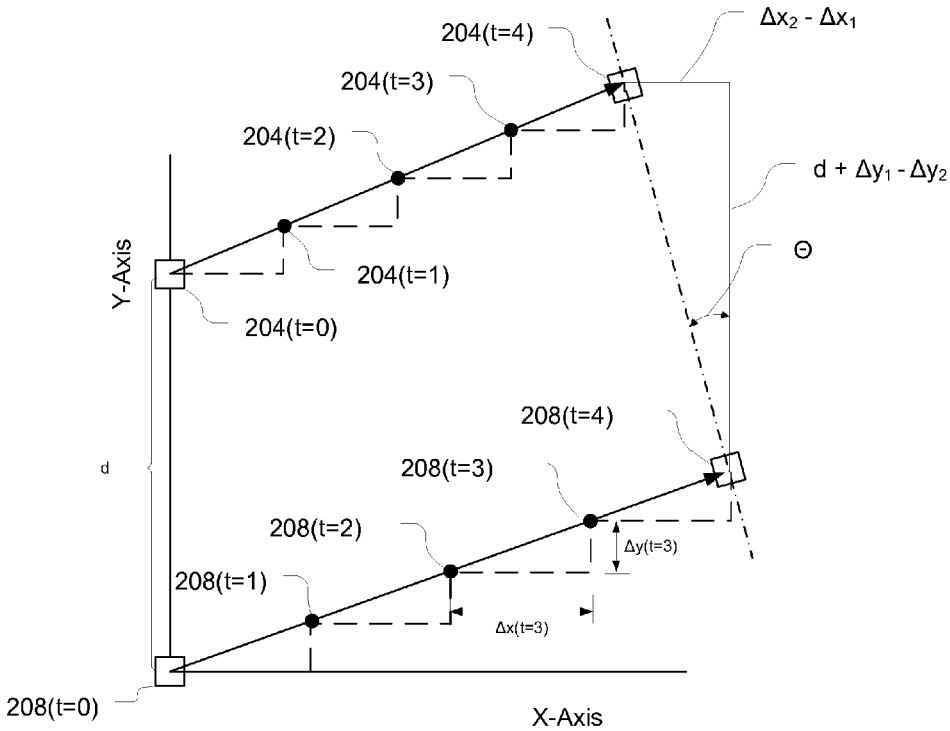
FIG. 6A is a graphic depiction of a positioning operation of a handheld printing device in accordance with various embodiments of the present invention.

FIG. 6A is a graphic depiction of a positioning operation of the printing device 200 when optical navigation sensors 204 and 208 are employed during a printing operation in accordance with embodiments of the present invention. At initiation, e.g., t=0, the sensors 204 and 208 may be in an initial position indicated by 204(t=0) and 208(t=0), respectively. Over successive time intervals, e.g., t=1-4, the navigation sensors 204 and 208 may be moved to an end position indicated by 204(t=4) and 208(t=4), respectively. As used in description of this embodiment, the "initial position" and the "end position" are used merely with reference to this particular operation and not necessarily the start or end of the printing operation or even other positioning operations.

As the sensors 204 and 208 are moved, they may capture navigational images at each of the indicated time intervals, e.g., t=0-4. The capture period may be synchronized between the sensors 204 and 208 by, e.g., hardwiring together the capture signals transmitted from the position module. The capture periods may vary and may be determined based on set time periods, detected motion, or some other trigger. In some embodiments, each of the sensors 204 and 208 may have different capture periods that may or may not be based on different triggers.

The captured navigational images may be used by the position module to determine a translation of the printing device 200 relative to a reference location, e.g., the sensors 204(t=0) and 208(t=0) as well as a rotation of the printing device 200. In some embodiments, the translation of the printing device 200 may be determined by analyzing navigational images from a first sensor, e.g., sensor 204, while the rotation of the printing device 200 may be determined by analyzing navigational images from a second sensor, e.g., sensor 208. In particular, and in accordance with some embodiments, the rotation of the printing device 200 may be determined by comparing translation information derived from the navigational images provided by sensor 208 to translation information derived from navigational images provided by sensor 204. Determining both the translation and the rotation of the printing device 200 may allow the accurate positioning of all of the nozzles of the print head 212.

The translation of the sensors 204 and 208 may be determined within the context of a coordinate system, e.g., a Cartesian coordinate system. In particular, the translation values may be determined for two-dimensions of the coordinate system, e.g., the x-axis and the y-axis as shown in FIG. 6A. For example, the position module may accumulate the incremental Δx's and Δy's between successive time periods in order to determine the total translation of the sensors 204 and 208 from time zero to time four. The accumulated changes for sensor 204 may be referred to as $\Delta x_1$ and $\Delta y_1$ and the accumulated changes for sensor 208 may be referred to as $\Delta x_2$ and $\Delta y_2$. The sensors 204 and 208 may be a distance d from one another.

Figure 6B:
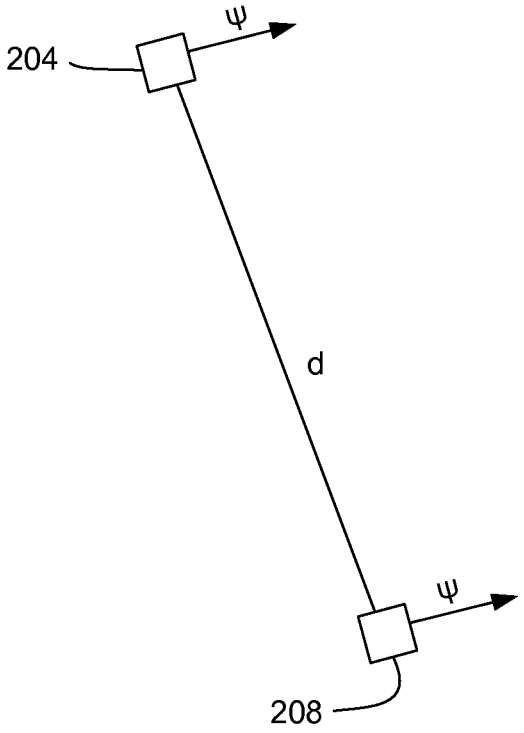
FIG. 6B is a graphic depiction of the two sensors 204 and 208 depicted in FIG. 6B in accordance with various embodiments of the present invention.

The movement recorded by the sensors 204 and 208 are relative to the sensor body (i.e., printing device 200). This illustration represents the sensor body being pinned down to the paper space. As the body of the system is rotated a movement of Δx in the space of the system is effectively a movement of Δx and Δy in the frame of the paper. The movement of the system (i.e., printing device 200) that contributes to the rotation is that movement along a track that is perpendicular to the line that connects the two sensors 204 and 208 separated by distance d. This is illustrated by FIG. 6B, which depicts the sensors 204 and 208 of FIG. 6A.

Each sensor 204 and 208 may report a different distance along this track much like the wheels of a car when it turns. The outside wheel will travel farther. The rotation of the system with respect to the world or paper coordinate system is proportional to the difference between accumulated distance traveled along that perpendicular track for the two sensors 204 and 208. As a result, the rotation θ of the printing device 200 may be determined by the following equation:

$$\theta=(\Sigma(\Delta 1*\psi)-\Sigma(\Delta 2*\psi))/d \quad \text{Eq. 1.}$$

where ψ is the unit vector perpendicular to the line connecting the two sensors 204 and 208.

In designing the printing device 200, the distance d may be established based at least in part on the desired resolution of the data output from the sensors 204 and 208. For example, if the sensors 204 and 208 have a resolution of approximately 1600 counts per inch, the distance d may be approximately two inches.

Figure 7:
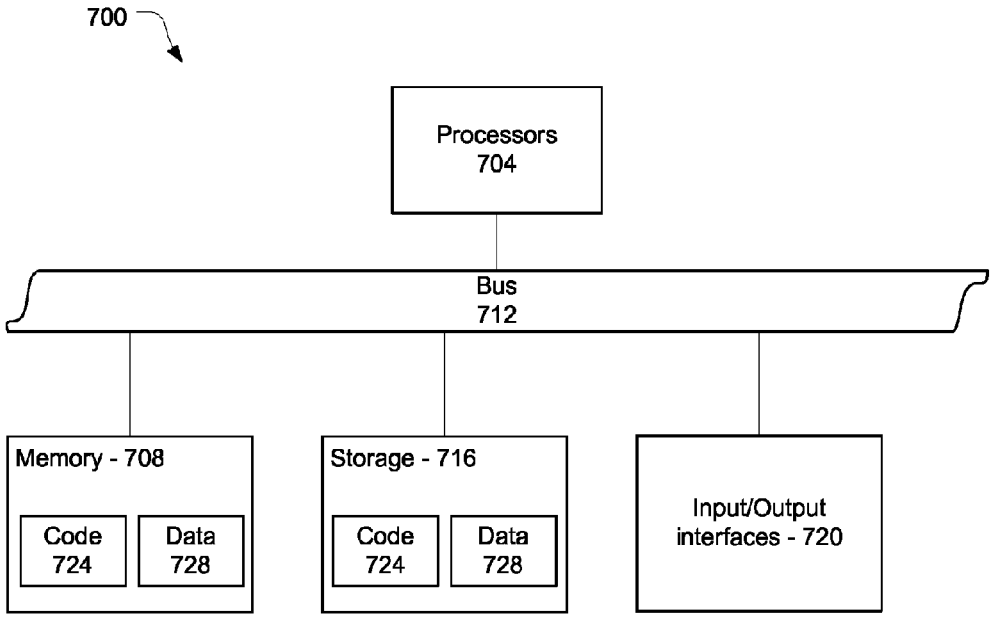
FIG. 7 illustrates a computing device capable of implementing a control block of a handheld printing device in accordance with various embodiments of the present invention.

FIG. 7 illustrates a computing device 700 capable of implementing a control block, e.g., control block 108, in accordance with various embodiments. As illustrated, for the embodiments, computing device 700 includes one or more processors 704, memory 708, and bus 712, coupled to each other as shown. Additionally, computing device 700 includes storage 716, and one or more input/output interfaces 720 coupled to each other, and the earlier described elements as shown. The components of the computing device 700 may be designed to provide the printing and/or positioning functions of a control block of a printing device as described herein.

Memory 708 and storage 716 may include, in particular, temporal and persistent copies of code 724 and data 728, respectively. In some embodiments, memory 708 may correspond to the memory 135 of FIG. 1. The code 724 may include computer readable programming instructions that when accessed by the processors 704 result in the computing device 700 performing operations as described in conjunction with various modules of the control block in accordance with embodiments of this invention. The processing data 728 may include data to be acted upon by the instructions of the code 724. In particular, the accessing of the code 724 and data 728 by the processors 704 may facilitate printing and/or positioning operations as described herein.

The processors 704 may include one or more single-core processors, multiple-core processors, controllers, application-specific integrated circuits (ASICs), etc.

The memory 708 may include random access memory (RAM), dynamic RAM (DRAM), static RAM (SRAM), synchronous DRAM (SDRAM), dual-data rate RAM (DDRRAM), etc.

The storage 716 may include integrated and/or peripheral storage devices, such as, but not limited to, disks and associated drives (e.g., magnetic, optical), USB storage devices and associated ports, flash memory, read-only memory (ROM), non-volatile semiconductor devices, etc. Storage 716 may be a storage resource physically part of the computing device 700 or it may be accessible by, but not necessarily a part of, the computing device 700. For example, the storage 716 may be accessed by the computing device 700 over a network.

The I/O interfaces 720 may include interfaces designed to communicate with peripheral hardware, e.g., print head 112, navigation sensors 138, etc., and/or remote devices, e.g., other devices 120.

In various embodiments, computing device 700 may have more or less elements and/or different architectures.

Although specific embodiments have been illustrated and described herein, it will be appreciated by those of ordinary skill in the art and others, that a wide variety of alternate and/or equivalent implementations may be substituted for the specific embodiment shown and described without departing from the scope of the present invention. This application is intended to cover any adaptations or variations of the embodiment discussed herein. Therefore, it is manifested and intended that the invention be limited only by the claims and the equivalents thereof.

What is claimed is:

1. A method for using a handheld printing device to print an image onto a medium, wherein the image is printed onto the medium based on a print head of the handheld printing device being moved in a back and forth motion over the medium, the method comprising:

in a first motion, of the back and forth motion, of the print head over a surface of the medium, depositing, via the print head, a substance onto the surface of a medium at a first location on the medium, determining a first tilt value of the print head relative to the surface of the print medium at the first location, and storing the first tilt value of the print head relative to the surface of the print head medium at the first location; and in a second motion, of the back and forth motion, of the print head over the surface of the medium, determining a second tilt value of the print head relative to the surface of the print medium at the first location;

performing a comparison of the first tilt value with the second tilt value; and during the second motion, selectively depositing the substance onto the surface of the medium at the first location based on the comparison of the first tilt value with the second tilt value.

2. The method of claim 1, wherein performing the comparison of the first tilt value with the second tilt value comprises determining whether a difference between (i) the first tilt value and (ii) the second tilt value is less than a predetermined value.

3. The method of claim 1, wherein selectively depositing the substance onto the surface of the medium is further based on image data of the image to be printed on the surface of the medium.

4. The method of claim 1, wherein selectively depositing the substance onto the surface of the medium comprises refraining from depositing the substance onto the surface of the medium at the first location when the comparison indicates that a distance between the print head and the surface of the print medium is greater than a predetermined distance.

5. An apparatus, comprising:

a print head configured to deposit a print substance onto a surface of a print medium;

a control block configured to control the print head to print an image onto a medium using a back-and-forth motion over the medium, the control block further configured to:

in a first motion, of the back-and-forth motion, of the print head over a surface of the medium, determine a first tilt value of the print head relative to the surface of the print medium at a first location, and store the first tilt value of the print head relative to the surface of the print head medium; and in a second motion, of the back and forth motion, of the print head over the surface of the medium, determine a second tilt value of the print head relative to the surface of the print medium at the first location;

perform a comparison of the first tilt value with the second tilt value; and selectively deposit the substance onto the surface of the medium at the first location based on the comparison of the first tilt value with the second tilt value.

6. The apparatus of claim 5, wherein control block is further configured to perform the comparison of the first tilt value with the second tilt value based on a difference between (i) the first tilt value and (ii) the second tilt value is less than a predetermined value.

7. The apparatus of claim 5, wherein the selectively deposition of the substance onto the surface of the medium is further based on image data of the image to be printed on the surface of the medium.

8. The apparatus of claim 5, wherein the control block is further configured to refrain from depositing the substance onto the surface of the medium at the first location when the comparison indicates that a distance between the print head and the surface of the print medium is greater than a predetermined distance.

* * * * *